US010704429B2

(12) United States Patent
Mariuz et al.

(10) Patent No.: US 10,704,429 B2
(45) Date of Patent: Jul. 7, 2020

(54) SWITCHABLE ROCKER ARM

(71) Applicant: DELPHI TECHNOLOGIES IP LIMITED, St. Michael (BB)

(72) Inventors: Robert M. Mariuz, Pittsford, NY (US); Kevin R. Keegan, Hilton, NY (US); Peter R. Charles, Rochester, NY (US); Hermes A. Fernandez, Pittsford, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/143,793

(22) Filed: Sep. 27, 2018

(65) Prior Publication Data

US 2020/0102859 A1 Apr. 2, 2020

(51) Int. Cl.

| | |
|---|---|
| ***F01L 1/18*** | (2006.01) |
| ***F01L 13/00*** | (2006.01) |
| *F01L 1/46* | (2006.01) |
| *F01L 1/24* | (2006.01) |

(52) U.S. Cl.

CPC ..... *F01L 1/181* (2013.01); *F01L 13/0005* (2013.01); *F01L 13/0015* (2013.01); *F01L 1/2405* (2013.01); *F01L 2001/186* (2013.01); *F01L 2001/467* (2013.01); *F01L 2105/02* (2013.01)

(58) Field of Classification Search

CPC ..... F01L 1/18; F01L 2001/186; F01L 1/181; F01L 1/2405; F01L 2001/467; F01L 2105/02

USPC ..... 123/90.39, 90.44

See application file for complete search history.

(56) References Cited

U.S. PATENT DOCUMENTS

| | | | | |
|---|---|---|---|---|
| 4,768,467 | A | 9/1988 | Yamada et al. | |
| 5,544,626 | A | 8/1996 | Diggs et al. | |
| 5,653,198 | A | 8/1997 | Diggs | |
| 6,314,928 | B1 | 11/2001 | Baraszu et al. | |
| 6,321,705 | B1 | 11/2001 | Fernandez et al. | |
| 6,532,920 | B1 | 3/2003 | Sweetnam et al. | |
| 7,305,951 | B2 | 12/2007 | Fernandez et al. | |
| 7,614,375 | B2 | 11/2009 | Tawaf et al. | |
| 7,798,113 | B2 | 9/2010 | Fischer et al. | |
| 7,882,814 | B2 | 2/2011 | Spath et al. | |
| 9,664,075 | B2 * | 5/2017 | McCarthy, Jr. | F01L 1/18 123/90.39 |
| 2001/0023672 | A1 | 9/2001 | Cecur | |
| 2001/0023675 | A1 | 9/2001 | Lee et al. | |

(Continued)

FOREIGN PATENT DOCUMENTS

| | | | |
|---|---|---|---|
| DE | 10155827 | A1 | 5/2003 |
| DE | 4444499 | C2 | 6/2003 |

(Continued)

*Primary Examiner* — Ching Chang

(74) *Attorney, Agent, or Firm* — Joshua M. Haines

(57) ABSTRACT

A rocker arm includes an outer arm and an inner arm which selectively pivots relative to the outer arm. The rocker arm also includes a lock pin which is displaced along a lock pin axis between a coupled position and a decoupled position. The rocker arm also includes a linkage and a linkage guide which guides the linkage along a linkage axis. One surface of the linkage engages an actuator while another surface of the linkage engages the lock pin such that the linkage translates motion from the actuator to motion of the lock pin.

14 Claims, 9 Drawing Sheets

(56) References Cited

U.S. PATENT DOCUMENTS

| | | | |
|---|---|---|---|
| 2005/0247279 | A1 | 11/2005 | Rorig et al. |
| 2019/0376420 | A1 | 12/2019 | Elendt et al. |

FOREIGN PATENT DOCUMENTS

| | | | |
|---|---|---|---|
| FR | 2995023 | A1 | 3/2014 |
| WO | 03042510 | A1 | 5/2003 |

* cited by examiner

SWITCHABLE ROCKER ARM

STATEMENT REGARDING FEDERALLY SPONSORED RESEARCH OR DEVELOPMENT

This invention was made with government support under Contract No. DE-EE-0007811 awarded by the United States Department of Energy. The government has certain rights in this invention.

TECHNICAL FIELD OF INVENTION

The present invention relates to a rocker arm for valve train of an internal combustion engine; more particularly to a rocker arm with an inner arm which selectively pivots relative to an outer arm, and even more particularly to such a rocker arm with linkage which translates motion from an actuator to a lock pin which is moved between a coupled position and an uncoupled position.

BACKGROUND OF INVENTION

Variable valve actuation mechanisms for internal combustion engines are well known. It is known to lower the lift, or even to provide no lift at all, of one or more valves of an internal combustion engine, during periods of light engine load. Such valve deactivation or valve lift switching can substantially improve one or more of fuel efficiency, emissions, and engine performance.

A rocker arm acts between a rotating eccentric camshaft lobe and a pivot point on the internal combustion engine, such as a hydraulic lash adjuster, to open and close an engine valve. Switchable rocker arms may be a "deactivation" type or a "two-step" type. The term switchable deactivation rocker arm, as used herein, means the switchable rocker arm is capable of switching from a valve lift mode to a no lift mode. The term switchable two-step rocker arm, as used herein, means the switchable rocker arm is capable of switching from a first valve lift mode to a second and lesser valve lift mode, that is greater than no lift. It should be noted that the second valve lift mode may provide one or both of decreased lift magnitude and decreased lift duration of the engine valve compared to the first valve lift mode. When the term "switchable rocker arm" is used herein, by itself, it includes both types.

A typical switchable rocker arm includes an outer arm and an inner arm. The inner arm is movably connected to the outer arm. It can be switched by a locking member, from a coupled mode wherein the inner arm is immobilized relative to the outer arm, to a decoupled mode wherein the inner arm can move relative to the outer arm. Typically, the outer arm of the switchable rocker arm is pivotally supported at a first end by the hydraulic lash adjuster. A second end of the outer arm operates against an associated engine valve for opening and closing the valve by the rotation of an associated eccentric cam lobe acting on an inner arm contact surface which may be a roller. The inner arm is connected to the outer arm for pivotal movement about the outer arm's second end with the contact surface of the inner arm disposed between the first and second ends of the outer arm. Typically, the locking member includes a locking pin disposed in a bore in the first end of the outer arm, the locking pin being selectively moved to engage the inner arm to thereby couple the inner arm to the outer arm when engaged, and decouple the inner arm from the outer arm when disengaged.

In a switchable two-step rocker arm, the outer arm typically supports a pair of rollers carried by a shaft. The rollers are positioned to be engaged by associated low-lift eccentric cam lobes that cause the outer arm to pivot about the hydraulic lash adjuster, thereby actuating an associated engine valve to a low-lift. The inner arm, in turn, is positioned to engage an associated high-lift eccentric cam lobe sandwiched between the aforementioned low-lift lobes. The switchable two-step rocker arm is then selectively switched between a coupled and a decoupled mode by the locking member. In the coupled mode, with the inner arm locked to the outer arm, the rotational movement of the central high-lift lobe is transferred from the inner arm, through the outer arm to cause pivotal movement of the rocker arm about the hydraulic lash adjuster, which in turn opens the associated valve to a high-lift. In the decoupled mode, the inner arm is no longer locked to the outer arm and is permitted to move relative to the outer arm against a lost motion spring that biases the inner arm away from the outer arm. In turn, the rollers of the outer arm engage their associated low-lift lobes. The rotational movement of the low-lift lobes is transferred directly through the outer arm, and the associated valve is reciprocated by the outer arm to a low-lift. It should be noted that high-lift and low-lift as used herein designates that high-lift encompasses one or both of greater magnitude of valve lift and greater duration of the valve being opened compared to low-lift.

A switchable deactivation rocker arm typically includes an outer arm and an inner arm. The inner arm supports a roller carried by a shaft. The roller is engaged by an eccentric lifting cam lobe for actuating an associated engine valve Like the switchable two-step rocker arm, the switchable deactivation rocker arm is selectively switched between a coupled and a decoupled mode by a movable locking member. In the coupled mode, the inner arm of the switchable deactivation rocker arm is locked to the outer arm and the rotational movement of the associated lifting cam lobe is transferred from the inner arm, through the outer arm to cause pivotal movement of the rocker arm about the hydraulic lash adjuster which in turn opens the associated valve to a prescribed lift. In the decoupled mode, the inner arm becomes unlocked from the outer arm and is permitted to pivot relative to the outer arm against a lost motion spring. In the decoupled mode, the rotational movement of the lifting cam lobe is absorbed by the inner arm in lost motion and is not transferred to the outer arm. Thus, the associated valve remains closed when the switchable deactivation rocker arm is in its decoupled mode.

Examples of switchable rocker arms are shown, for example, in U.S. Pat. Nos. 5,544,626; 5,653,198; 6,314,928; 6,532,920; 7,614,375; 7,798,113; and 7,882,814 and United States Patent Application Publication Numbers US 2005/0247279 A1 and US 2001/0023675 A1.

Switching of the locking pin for changing the mode of switchable rocker arms has commonly been accomplished by applying pressurized oil, and draining pressurized oil from, the locking pin. However, in order to decrease the time needed to switch between modes and to reduce parasitic loss on the lubrication system which provides the oil for switching the locking pin, it may be desirable to switch the lock pin with a solenoid. Furthermore, it may be desirable to allow flexible placement of the solenoid without substantial redesign of the rocker arm.

What is needed is a rocker arm which provides the aforementioned desires.

SUMMARY OF THE INVENTION

Briefly described, a rocker arm is provided for transmitting rotational motion from a camshaft to opening and closing motion of a combustion valve in an internal combustion engine. The rocker arm includes an outer arm; an inner arm which selectively pivots relative to the outer arm about a pivot axis; a lost motion spring which biases the inner arm to pivot relative to the outer arm in a first rotational direction; a lock pin which is displaced along a lock pin axis between 1) a coupled position in which the lock pin prevents the inner arm from pivoting relative to the outer arm past a predetermined position of the inner arm relative to the outer arm in a second rotational direction which is opposite of the first rotational direction and 2) a decoupled position in which the lock pin allows the inner arm to pivot relative to the outer arm past the predetermined position in the second rotational direction; a linkage which is slidable along a linkage axis, the linkage comprising a first linkage portion through which the linkage axis passes; a second linkage portion which extends from the first linkage portion laterally outward from the linkage axis and includes a second linkage portion surface which is configured to engage an actuator which causes the linkage to slide along the linkage axis; and a third linkage portion which extends from the first linkage portion laterally outward from the first linkage portion and which includes a third linkage portion surface which engages the lock pin such that movement of the linkage along the linkage axis affects the position of the lock pin along the lock pin axis; and guiding means which guides the linkage along the linkage axis. The rocker arm with linkage described herein allows for flexibility in mounting the actuator, thereby accommodating different cylinder head configurations.

BRIEF DESCRIPTION OF DRAWINGS

This invention will be further described with reference to the accompanying drawings in which.

DETAILED DESCRIPTION OF INVENTION

Figure 1:
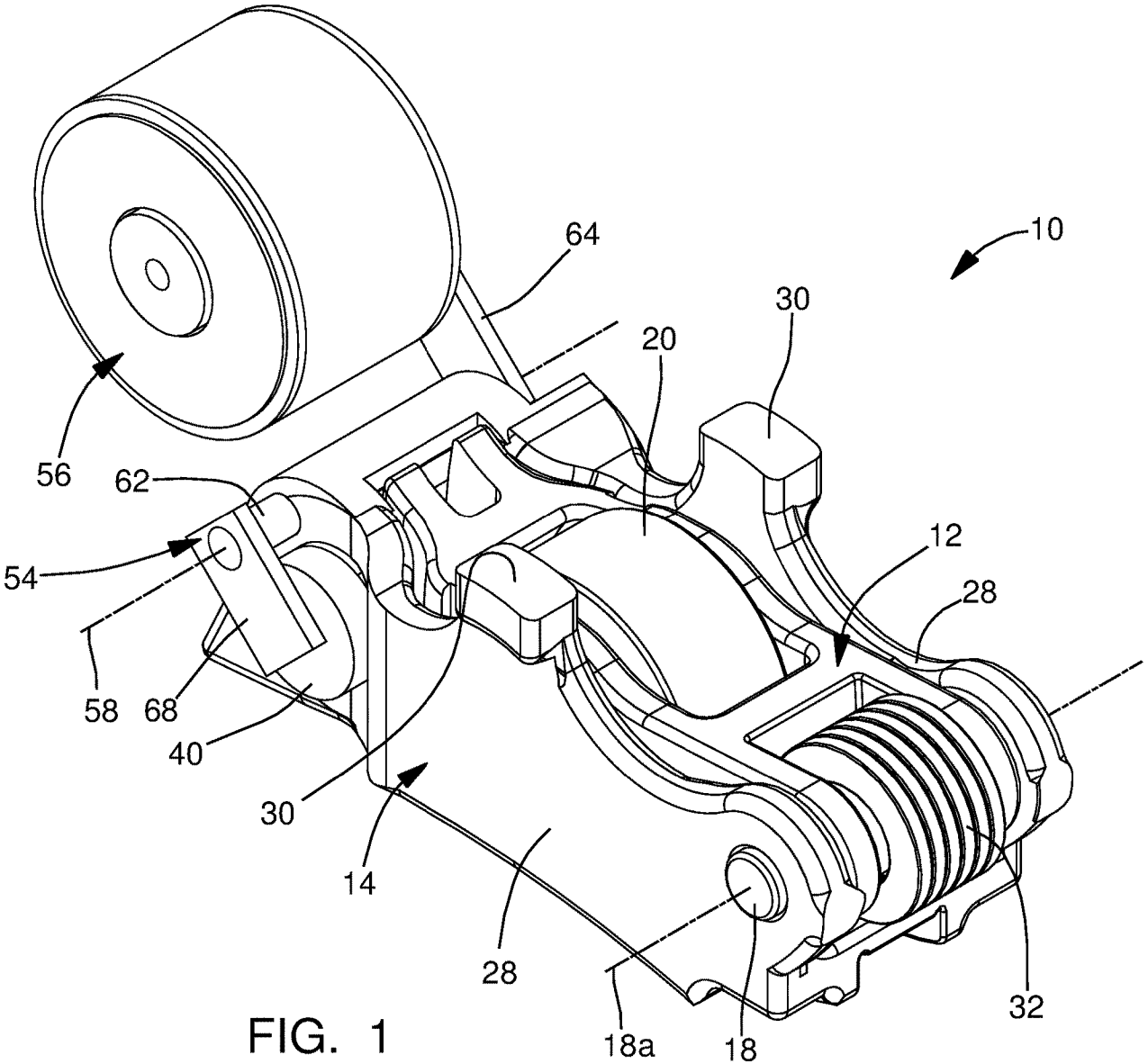
FIG. 1 is an isometric view of a rocker arm in accordance with the present invention shown with an actuator for actuating the rocker arm.
Figure 2:
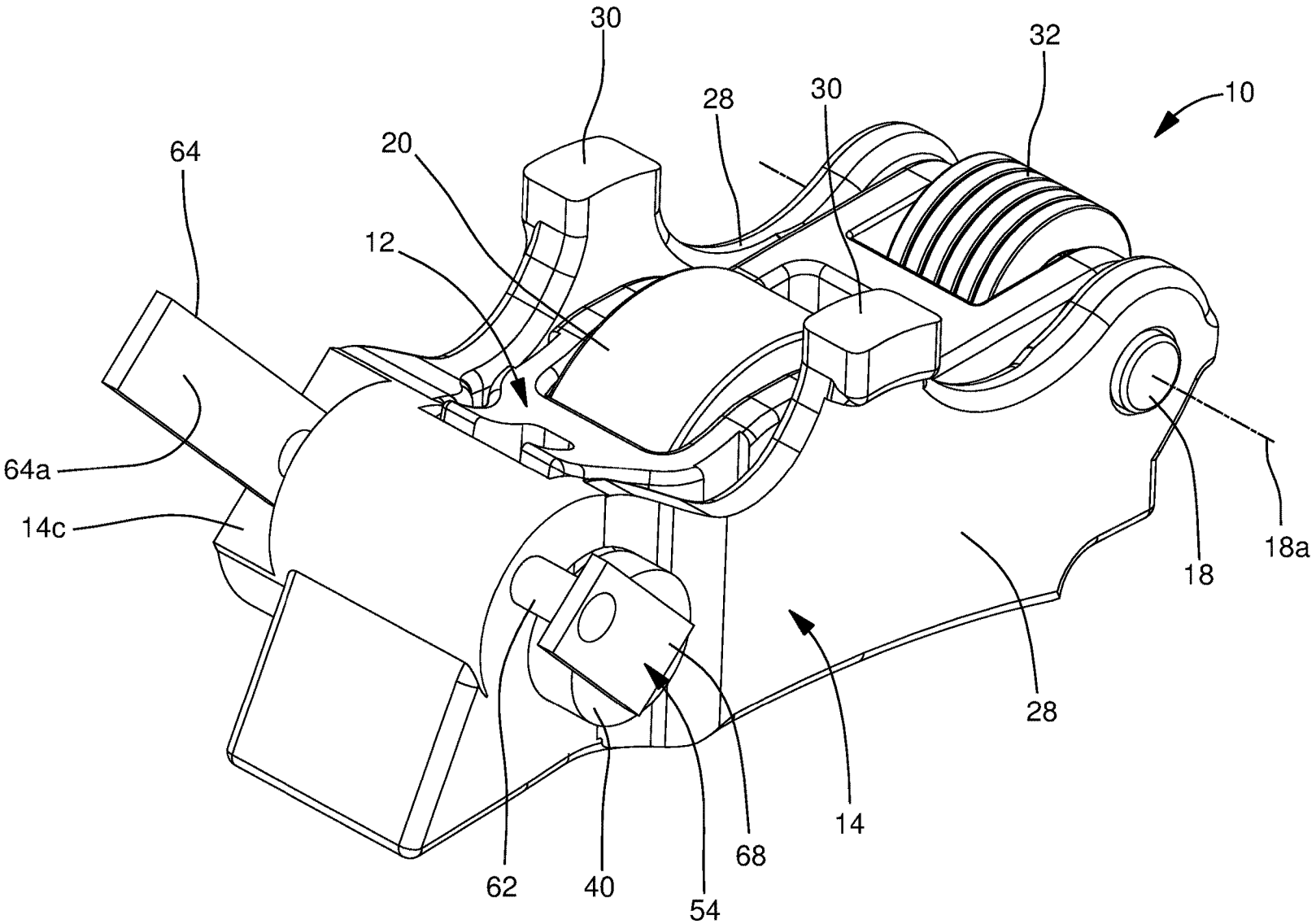
FIG. 2 is an isometric view of the rocker arm of FIG. 1, now shown from a different perspective.
Figure 3:
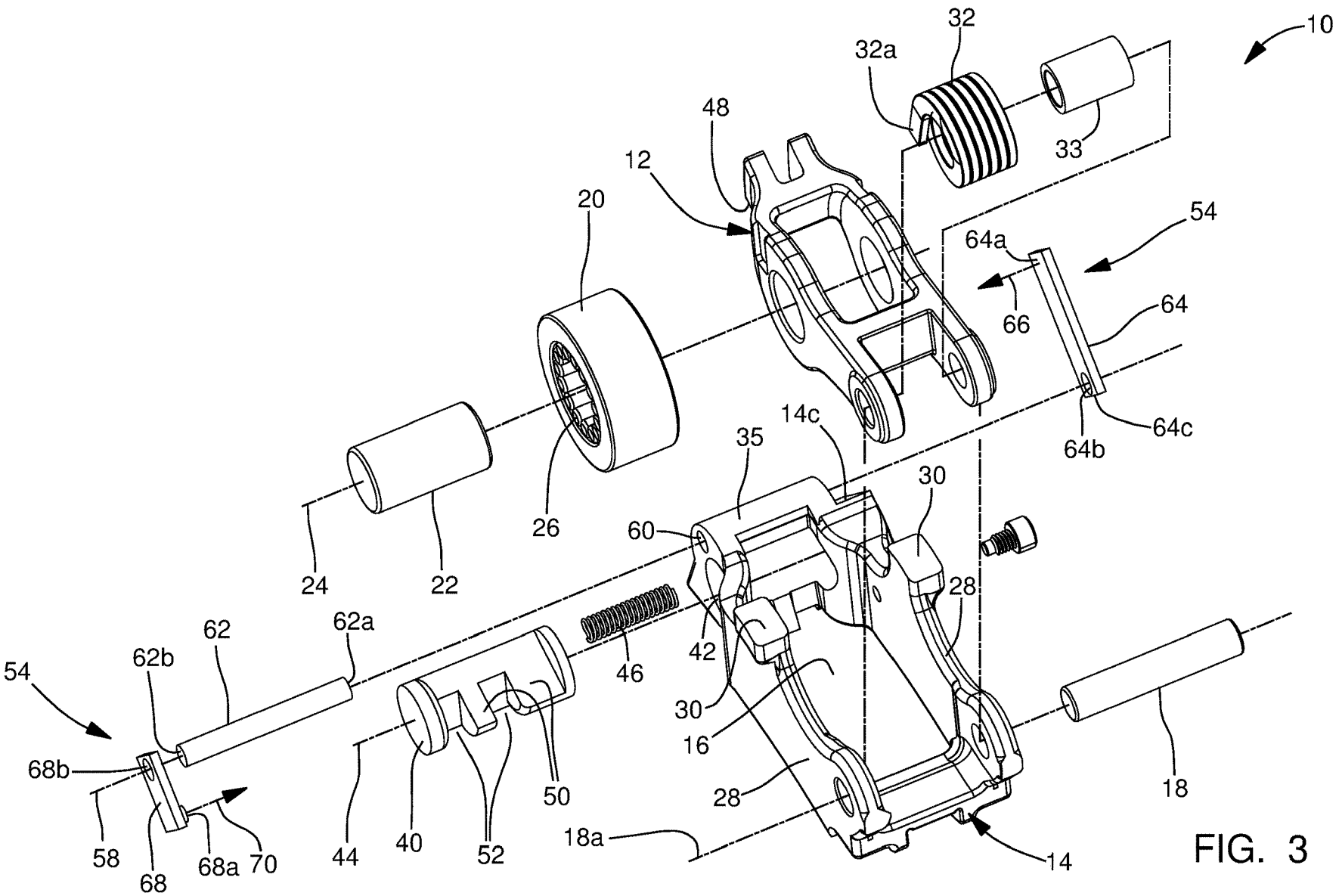
FIG. 3 is an exploded isometric view of the rocker arm of FIG. 1.

Referring initially to FIGS. 1-7, a rocker arm 10 in accordance with the invention is illustrated where rocker arm 10 is either a two-step rocker arm or a deactivation rocker arm, which may generically be referred to as a switchable rocker arm. Rocker arm 10 is included in valve train (not shown) of an internal combustion engine (not shown) in order to translate rotational motion of a camshaft (not shown) to reciprocating motion of a combustion valve (not shown). Rocker arm 10 includes an inner arm 12 that is pivotably disposed in a central opening 16 of an outer arm 14. Inner arm 12 is supported by, and selectively pivots within, outer arm 14 about a pivot shaft 18 which is supported at opposite ends thereof by outer arm 14 which is centered about, and extends along, a pivot axis 18*a*. Inner arm 12 includes a follower illustrated as a roller 20 carried by a roller shaft 22 that is supported by inner arm 12 such that roller 20 and roller shaft 22 are centered about a roller shaft axis 24. Roller 20 is configured to follow a lobe of the camshaft, for example a high-lift lobe, to impart lifting motion on a respective combustion valve. A bearing 26 may rotatably support roller 20 on roller shaft 22 for following a cam lobe of a lifting cam of an engine camshaft (not shown). Bearing 26 may be, for example, a plurality of rollers or needle bearings. Roller shaft 22 is fixed to inner arm 12, by way of non-limiting example only by staking each end of roller shaft 22 in order to cause each end of roller shaft 22 to be increased in diameter to prevent removal from inner arm 12. Outer arm 14 includes two walls 28 positioned parallel to each other such that walls 28 are perpendicular to roller shaft axis 24 and such that walls 28 are spaced apart from each other to define central opening 16 therebetween. Outer arm 14 also includes followers 30 such that one follower 30 is fixed to each wall 28. As shown, followers 30 may be sliding surfaces, but may alternatively be rollers. Followers 30 are configured to follow respective lobes of the camshaft, for example low-lift lobes which impart lifting motion on a respective combustion valve or null lobes which do not impart lifting motion on a respective combustion valve. A lost motion spring 32 acts between inner arm 12 and outer arm 14 to pivot inner arm 12 away from outer arm 14 in a first rotational direction (clockwise as viewed in FIGS. 4 and 5). More particularly, lost motion spring 32 may be a coiled torsion spring which circumferentially surrounds a central portion of pivot shaft 18 with a bushing 33 disposed radially between pivot shaft 18 and lost motion spring 32 such that a spring first end 32*a* is grounded to inner arm 12 and such that a spring second end 32*b* is grounded to outer arm 14. A socket 34 for pivotably mounting rocker arm 10 on a lash adjuster (not shown) is included in an outer arm body 35 at a first end 14*a* of outer arm 14 where outer arm body 35 connects walls 28 at first end 14*a* while a pad 36 for actuating a valve stem (not shown) is included at a second end 14*b* of outer arm 14 such that pad 36 extends between each wall 28, thereby connecting walls 28 at second end 14*b*. A lock pin 40 disposed within outer arm 14 near first end 14*a* thereof selectively permits inner arm 12 to pivot relative to outer arm 14 about pivot shaft 18 and also selectively prevents inner arm 12 from pivoting relative to outer arm 14 about pivot shaft 18 as will be described in greater detail later. While the follower of inner arm 12 has been illustrated as roller 20, it should be understood that the follower of inner arm 12 may alternatively be a sliding surface as shown in U.S. Pat. No. 7,305,951 to Fernandez et al. Similarly, while followers 30 of outer arm 14 have been illustrated as sliding surfaces, it should be understood that followers 30 may alternatively be rollers as shown in U.S. Pat. No. 7,305,951. It should also be understood that the followers of inner arm 12 and outer arm 14 may all be rollers or may all be sliding surfaces. Additionally, while lost motion spring 32 has been illustrated as a coiled torsion spring which circumferentially surrounds pivot shaft 18, it should be understood that lost motion spring 32 may take numerous other forms, which may be, by way of non-limiting example only, a coiled torsion spring which does not circumferentially surround pivot shaft 18 or a compression spring which acts between opposing surfaces of inner arm 12 and outer arm 14.

Figure 4:
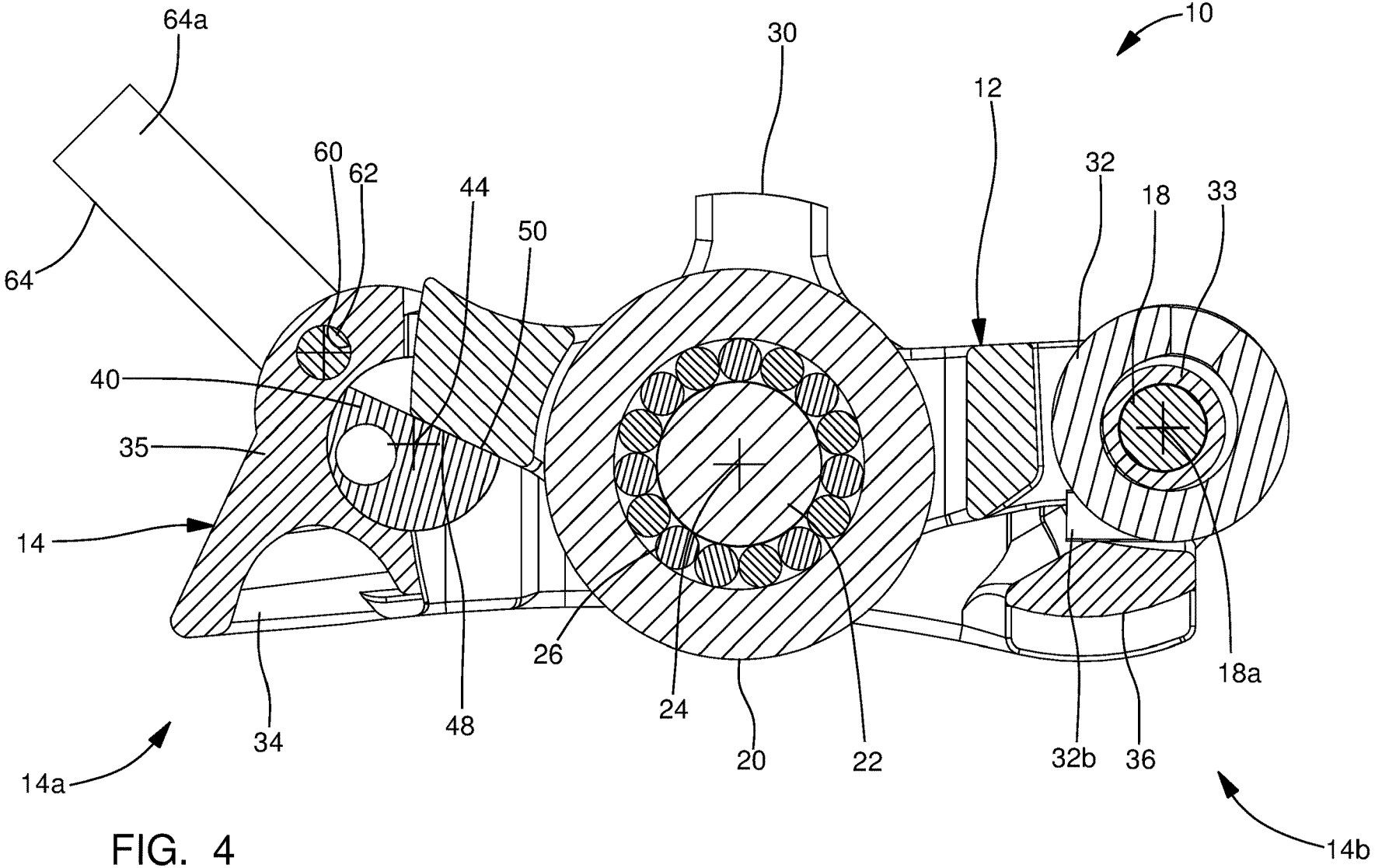
FIG. 4 is a cross-sectional view of the rocker arm of FIG. 1, taken through a plane that is perpendicular to an axis about which an inner arm of the rocker arm pivots relative to an outer arm of the rocker arm, shown in a coupled state.
Figure 5:
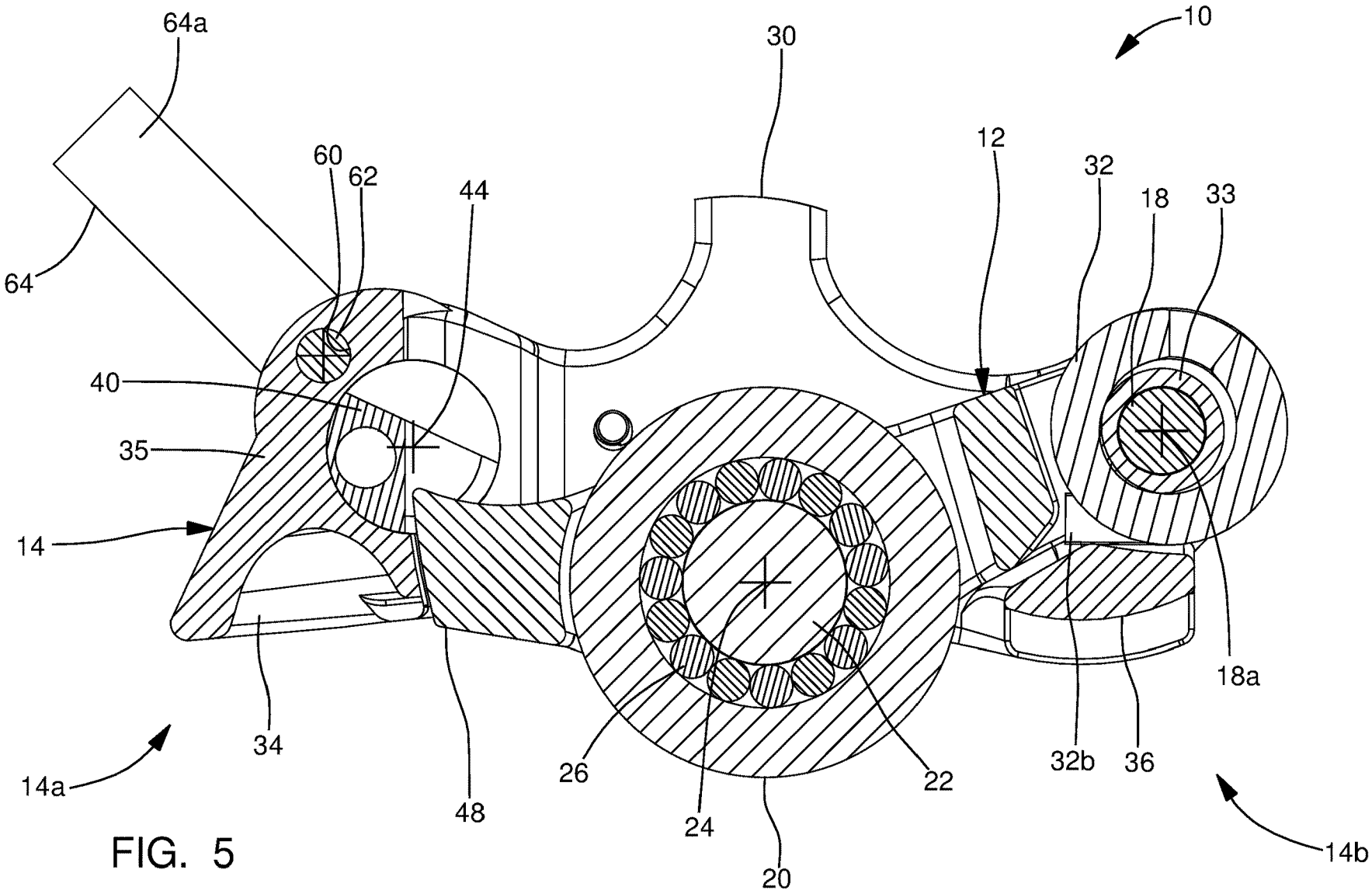
FIG. 5 is the cross-sectional view of FIG. 4, now showing the rocker arm in a decoupled state.

Rocker arm 10 is selectively switched between a coupled state and a decoupled state by lock pin 40. In the coupled state as shown in FIG. 4, inner arm 12 is prevented from pivoting relative to outer arm 14 past a predetermined position of inner arm 12 relative to outer arm 14 in a second rotational direction, shown as counterclockwise in FIG. 4, which is opposite from the first rotational direction. In this way, in the coupled state, inner arm 12, and therefore roller shaft 22, is coupled to outer arm 14, and rotation of the lifting cam is transferred from roller 20 through roller shaft 22 to pivotal movement of outer arm 14 about the lash adjuster which, in turn, reciprocates the associated valve. In the decoupled state as shown in FIG. 5, inner arm 12 is able to pivot relative to outer arm 14 past the predetermined position in the second rotational direction, i.e. counterclockwise as viewed in FIG. 5. In this way, in the decoupled state, inner arm 12, and therefore roller shaft 22, is decoupled from outer arm 14. Thus, roller shaft 22 does not transfer rotation of the lifting cam to pivotal movement of outer arm 14, and the associated valve is not reciprocated. Rather, inner arm 12 together with roller 20 and roller shaft 22 reciprocate within central opening 16, thereby compressing and uncompressing lost motion spring 32 in a cyclic manner such that lost motion spring 32 biases inner arm 12 to pivot relative to outer arm 14 in the first rotational direction, shown as clockwise in FIG. 5.

Lock pin 40 is slidably disposed within a lock pin bore 42 in outer arm 14 such that lock pin bore 42 is centered about, and extends along, a lock pin axis 44 which may be parallel to, and laterally offset from, pivot axis 18*a* as embodied herein. Lock pin 40 selectively engages inner arm 12 as shown in FIG. 4, thereby preventing inner arm 12 from pivoting relative to outer arm 14 in the second direction past the predetermined position. Lock pin 40 also selectively disengages inner arm 12 as shown in FIG. 5, thereby allowing inner arm 12 to pivot relative to outer arm 14 in the second direction past the predetermined position. A lock pin spring 46 is provided to move lock pin 40 into engagement with inner arm 12 when desired, as shown in FIG. 4, to achieve the coupled state. Lock pin spring 46 is positioned in a blind end of lock pin bore 42 and consequently is grounded to outer arm 14. When lock pin 40 is moved to achieve the coupled state, an inner arm stop surface 48 of inner arm 12 are aligned with a lock pin stop surface 50 of lock pin 40, thereby preventing inner arm 12 from pivoting relative to outer arm 14 in the second direction past the predetermined position. It should be noted that inner arm stop surface 48 of inner arm 12 acts over the center of lock pin 40, thereby preventing rotation of lock pin 40 about lock pin axis 44. Conversely, when lock pin 40 is moved to achieve the decoupled state, lock pin stop surface 50 is moved out of alignment with inner arm stop surface 48 and lock pin slots 52 of lock pin 40 are moved into alignment with inner arm stop surface 48. Lock pin slots 52 are sufficiently large to allow the portion of inner arm 12 which includes inner arm stop surface 48 to pass therethrough. The manner in which lock pin 40 is moved to achieve the coupled state and to achieve the decoupled state will be described in greater detail later.

Rocker arm 10 includes linkage 54 which is configured to translate motion from an actuator, illustrated herein as solenoid 56, to displacement of lock pin 40 along lock pin axis 44. Linkage 54 is slidable along a linkage axis 58 based on the position of solenoid 56 as will be described in greater detail later. As illustrated herein, linkage axis 58 may preferably be parallel to lock pin axis 44, but may alternatively be other than parallel to lock pin axis 44. Linkage 54 is guided along linkage axis 58 by a guiding means 60, illustrated in FIGS. 1-7 as a bore in outer arm 14, and more particularly, in outer arm body 35 where guiding means 60 is hereinafter referred to as guiding bore 60. Linkage 54 includes a first linkage portion 62 through which linkage axis 58 passes. As illustrated herein, first linkage portion 62 may be cylindrical and centered about, and extending along, linkage axis 58. Similarly, guiding bore 60 may be cylindrical and centered about, and extending along, linkage axis 58 such that first linkage portion 62 and guiding bore 60 are sized to interface in a close sliding fit which prevents radial movement of first linkage portion 62 within guiding bore 60 while allowing first linkage portion 62 to freely slide along linkage axis 58. While first linkage portion 62 and guiding bore 60 have each been illustrated herein as being cylindrical, other shapes are anticipated for one or both of first linkage portion 62 and guiding bore 60 which prevent radial movement of first linkage portion 62 within guiding bore 60 while allowing first linkage portion 62 to freely slide along linkage axis 58. Linkage 54 also includes a second linkage portion 64 which extends from first linkage portion 62 in a direction radially outward from linkage axis 58 where second linkage portion 64 includes a second linkage portion surface 64*a* which is configured to engage solenoid 56 as will be described in greater detail later and which faces in a second linkage portion surface direction illustrated by arrow 66 in FIG. 3 which is parallel to, and laterally offset from, linkage axis 58. As shown, second linkage portion 64 may be a separate piece which is fixed to first linkage portion 62 proximal to a first linkage portion first end 62*a* of first linkage portion 62. Second linkage portion 64 may include a second linkage portion bore 64*b* extending therethrough such that second linkage portion bore 64*b* is centered about, and extends along, linkage axis 58 and such that first linkage portion 62 is received within second linkage portion bore 64*b*. Second linkage portion 64 may be fixed to first linkage portion 62, by way of non-limiting example only, by one or more of interference fit of first linkage portion 62 within second linkage portion bore 64*b*, welding, adhesives, and mechanical fasteners. While second linkage portion 64 has been illustrated herein as being a separate piece which is fixed to first linkage portion 62, it should be understood that second linkage portion 64 may alternatively be integrally formed as a single piece of material with first linkage portion 62, for example, by casting, forging, molding, bending, and combinations thereof. Linkage 54 also includes a third linkage portion 68 which extends from first linkage portion 62 in a direction radially outward from linkage axis 58 where third linkage portion 68 includes a third linkage portion surface 68*a* which engages lock pin 40 such that movement of linkage 54 along linkage axis 58 affects the position of lock pin 40 along lock pin axis 44 as will be as will be described in greater detail later. As should be clear from the figures, lock pin axis 44 passes through third linkage portion 68 at third linkage portion surface 68*a*, however, lock pin axis 44 does not pass through second linkage portion 64. Third linkage portion surface 68*a* faces in a third linkage portion surface direction illustrated by arrow 70 in FIG. 3 which is parallel to, and laterally offset from, linkage axis 58 and which is opposite in direction relative to arrow 66. As shown third linkage portion 68 may be a separate piece which is fixed to first linkage portion 62 proximal to a first linkage portion second end 62*b* of first linkage portion 62 where first linkage portion second end 62*b* is at the opposite end of first linkage portion 62 from first linkage portion first end 62*a*. Third linkage portion 68 may include a third linkage portion bore 68*b* extending therethrough such that third linkage portion bore 68*b* is centered about, and extends along, linkage axis 58 and such that first linkage portion 62 is received within third linkage portion bore 68*b*. Third linkage portion 68 may be fixed to first linkage portion 62, by way of non-limiting example only, by one or more of interference fit of first linkage portion 62 within third linkage portion bore 68*b*, welding, adhesives, and mechanical fasteners. While third linkage portion 68 has been illustrated herein as being a separate piece which is fixed to first linkage portion 62, it should be understood that third linkage portion 68 may alternatively be integrally formed as a single piece of material with first linkage portion 62, for example, by casting, forging, molding, bending, and combinations thereof.

In order to prevent rotation of linkage 54 relative to outer arm 14, linkage 54 is provided with an anti-rotation surface which engages a complementary anti-rotation surface of outer arm 14. As illustrated herein, second linkage portion 64 includes a second linkage portion anti-rotation surface 64*c* at one end thereof which engages an outer arm anti-rotation surface 14*c* formed on outer arm body 35. Also as illustrated herein, second linkage portion anti-rotation surface 64*c* and outer arm anti-rotation surface 14*c* may each be planar. Alternatively, first linkage portion 62 and guiding bore 60 may be shaped to prevent rotation of linkage 54 relative to outer arm 14.

Figure 6:
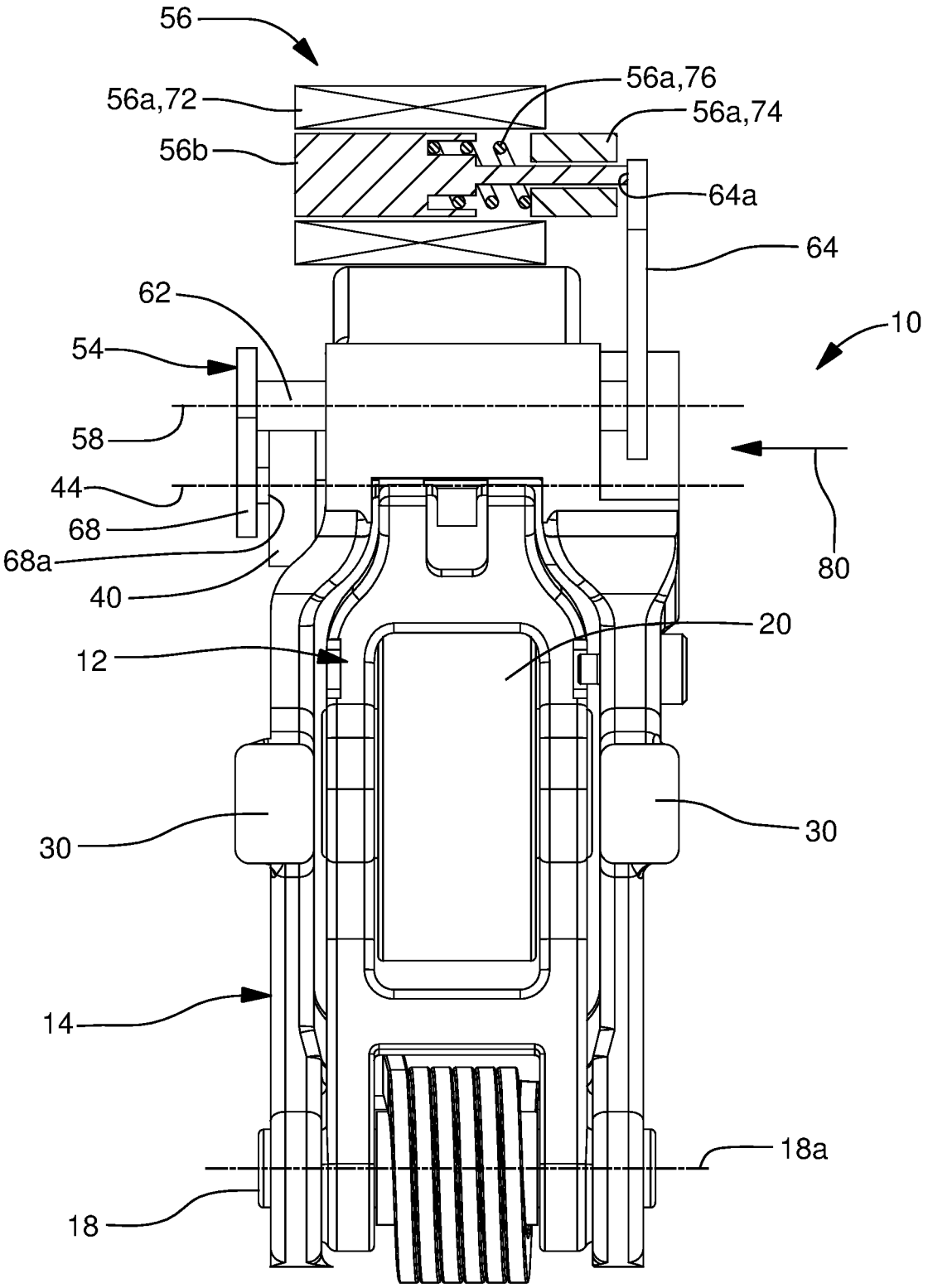
FIG. 6 is a top view of the rocker arm of FIG. 1 shown with the actuator show sectioned in schematic form and positioned to place the rocker arm in the coupled state.
Figure 7:
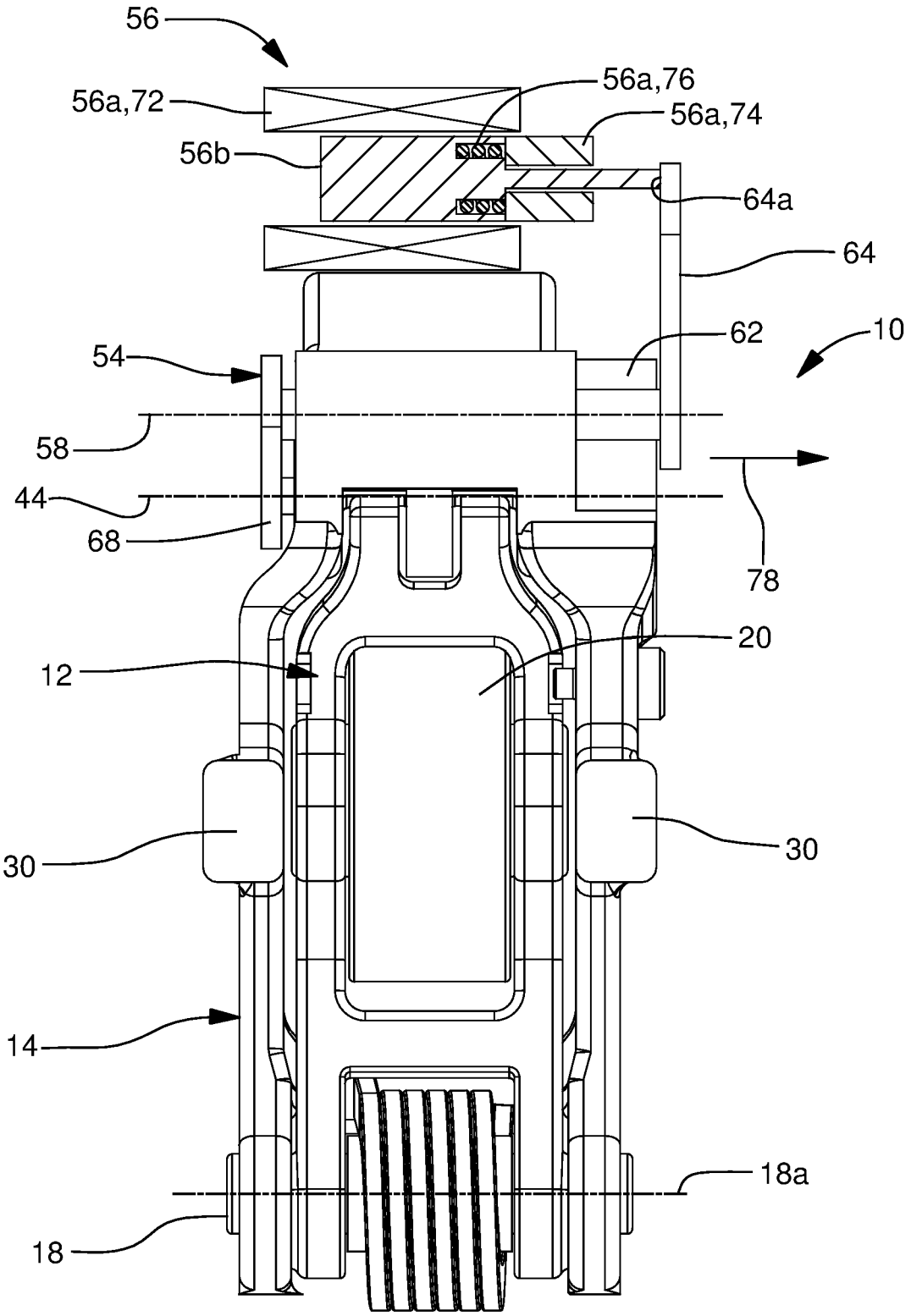
FIG. 7 is the top view of FIG. 6, now shown with the actuator positioned to place the rocker arm in the decoupled state.

Solenoid 56 includes a solenoid fixed portion 56*a* and a solenoid moveable portion 56*b* where solenoid fixed portion 56*a* includes a wire winding 72, a pole piece 74, and a return spring 76 which are shown schematically only in FIGS. 6 and 7 which are widely known to those of ordinary skill in the art and will not be described further herein. Solenoid moveable portion 56*b* is an armature which is magnetically attracted to pole piece 74 upon application of an electric current to wire winding 72. Consequently, when an electric current is applied to the wire winding 72, solenoid moveable portion 56*b* moves toward pole piece 74, thereby compressing return spring 76. Conversely, when the electric current to wire winding 72 is stopped, return spring 76 moves solenoid moveable portion 56*b* away from pole piece 74. Alternatively, return spring 76 may be omitted and lock pin spring 46 may provide the function of moving solenoid moveable portion 56*b* away from pole piece 74. Solenoids, their elements, and their operation are well known to those of ordinary skill in the art, and consequently, solenoid 56 will not be described in greater detail herein.

In operation, when it is desired to place rocker arm 10 in the decoupled state as shown in FIGS. 5 and 7, wire winding 72 is energized with an electric current, thereby causing solenoid moveable portion 56*b* to move toward second linkage portion 64, thereby reacting on second linkage portion 64 and moving linkage 54 in a first linkage direction 78 along linkage axis 58. As a result of linkage 54 moving in first linkage direction 78, third linkage portion 68 urges lock pin 40 to be positioned such that lock pin stop surface 50 is moved out of alignment with inner arm stop surface 48 and lock pin slots 52 of lock pin 40 are moved into alignment with inner arm stop surface 48 as described earlier. Conversely, when it is desired to place rocker arm 10 in the coupled state as shown in FIGS. 4 and 6, electric current to wire winding 72 is ceased, thereby causing return spring 76 to move solenoid moveable portion 56*b* away from second linkage portion 64. Since solenoid moveable portion 56*b* is no longer urging against second linkage portion 64, lock pin spring 46 moves lock pin 40 toward third linkage portion 68, thereby moving linkage 54 in a second linkage direction 80 along linkage axis 58. As a result, inner arm stop surface 48 of inner arm 12 are aligned with lock pin stop surface 50 as described earlier.

Figure 8:
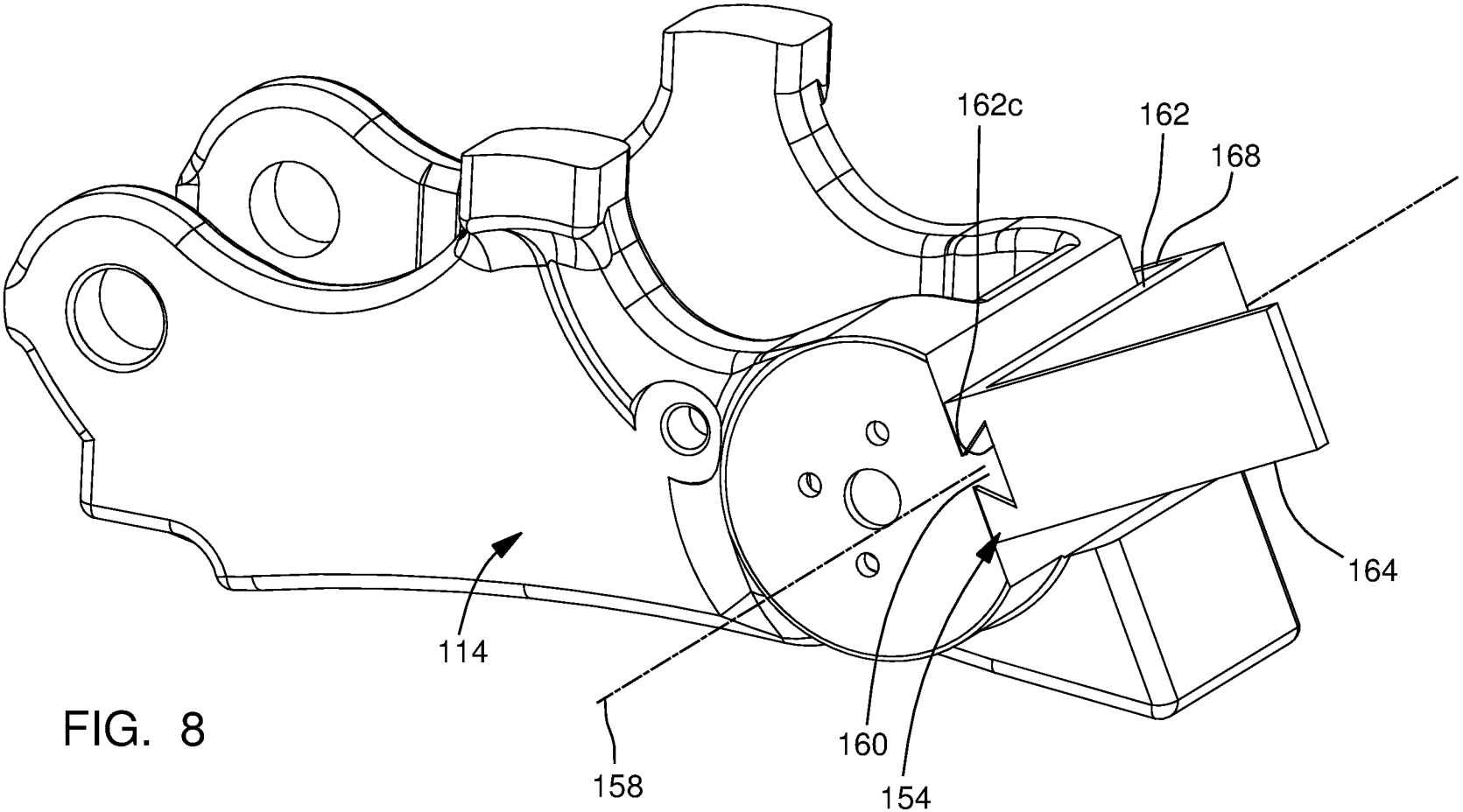
FIGS. 8 and 9 are isometric views of outer arms of the rocker arm of FIG. 1 showing alternative linkage arrangements for translating motion from the actuator to the lock pin.

In an alternative arrangement as shown in FIG. 8, an alternative outer arm 114 is shown to illustrate an alternative to linkage 54 where linkage 154 is shown which is slidable along a linkage axis 158 based on the position of solenoid 56 (not shown in FIG. 8). Linkage 154 is guided along linkage axis 158 by a guiding means 160, illustrated herein as a male dovetail protrusion on outer arm 114. Linkage 154 includes a first linkage portion 162 through which linkage axis 158 passes. First linkage portion 162 includes a female dovetail recess 162*c* which is complementary to guiding means 160 such that guiding means 160 is located within female dovetail recess 162*c* and such that lateral movement of linkage 154 relative to linkage axis 158 is prevented while allowing linkage 154 to move freely along linkage axis 158. Similar to linkage 54, linkage 154 includes second linkage portion 164 and third linkage portion 168 which only differ from second linkage portion 64 and third linkage portion 68 in that they are illustrated as being formed integrally as a single piece of material with first linkage portion 162, and consequently, second linkage portion bore 64*b* and third linkage portion bore 68*b* are omitted. However, it should be understood that second linkage portion 164 and third linkage portion 168 may alternatively be separate pieces that are joined to first linkage portion 162. The operation of linkage 154 is the same as linkage 54 which was described previously, and consequently, the operation of linkage 154 will not be described further herein. It should be noted that the other elements and operation of a rocker arm which includes outer arm 114 and linkage 154 is the same as previously describe relative to rocker arm 10.

Figure 9:
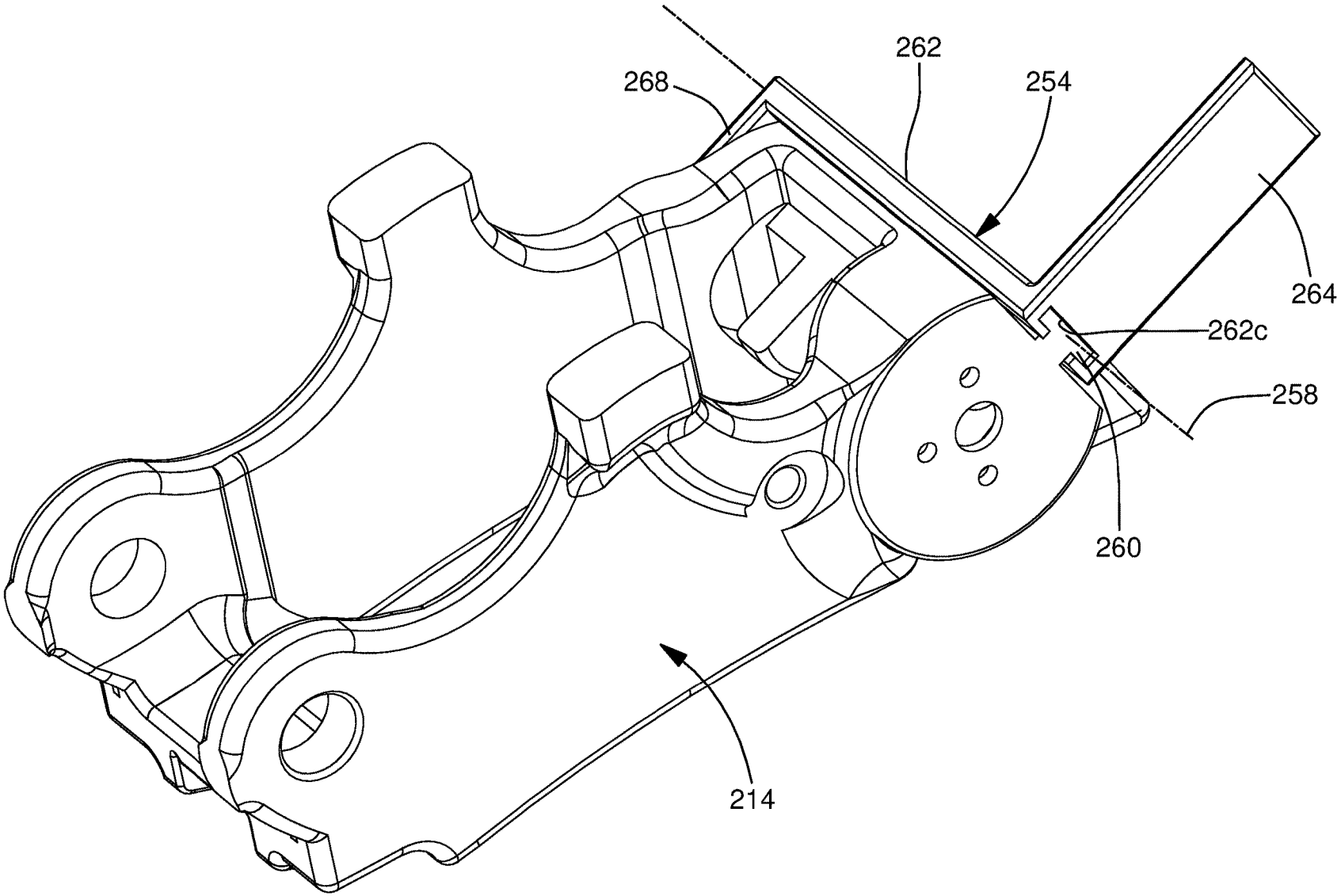

In another alternative arrangement as shown in FIG. 9, another alternative outer arm 214 is shown to illustrate an alternative to linkage 54 where linkage 254 is shown which is slidable along a linkage axis 258 based on the position of solenoid 56 (not shown in FIG. 9). Linkage 254 is guided along linkage axis 258 by a guiding means 260, illustrated herein as a male T-protrusion on outer arm 214. Linkage 254 includes a first linkage portion 262 through which linkage axis 258 passes. First linkage portion 262 includes a female T-recess 262*c* which is complementary to guiding means 260 such that guiding means 260 is located within female T-recess 262*c* and such that lateral movement of linkage 254 relative to linkage axis 258 is prevented while allowing linkage 254 to move freely along linkage axis 258. Similar to linkage 54, linkage 254 includes second linkage portion 264 and third linkage portion 268 which only differ from second linkage portion 64 and third linkage portion 68 in that they are formed integrally as a single piece of material with first linkage portion 262, and consequently, second linkage portion bore 64*b* and third linkage portion bore 68*b* are omitted. However, it should be understood that second linkage portion 264 and third linkage portion 268 may alternatively be separate pieces that are joined to first linkage portion 262. The operation of linkage 254 is the same as linkage 54 which was described previously, and consequently, the operation of linkage 254 will not be described further herein. It should be noted that the other elements and operation of a rocker arm which includes outer arm 214 and linkage 254 is the same as previously describe relative to rocker arm 10.

Rocker arm 10 which includes one of linkages 54, 154, 254 as described herein allows for flexibility in mounting solenoid 56 in order to accommodate different cylinder head designs that exist in a variety of internal combustion engine arrangements. More specifically, solenoid 56 need not be located laterally, i.e. in the direction of lock pin axis 44, relative to rocker arm 10 where space within a cylinder head is often limited. Instead, linkages 54, 154, 254 allow solenoid 56 to located in a position that is lateral to lock pin axis 44. As should now be understood, deviation in placement of solenoid 56 can be accomplished by simply altering the length of second linkage portion 64, 164, 264 or by altering the angular attachment of second linkage portion 64, 164, 264 relative to first linkage portion 62, 162, 262, i.e. second linkage portion 64, 164, 264 may be rotated relative to first linkage portion 62, 162, 262 compared to the angular relationship illustrated herein in the figures, however, the remainder of rocker arm 10 may be left essentially unchanged.

While this invention has been described in terms of preferred embodiments thereof, it is not intended to be so limited, but rather only to the extent set forth in the claims that follow.

We claim:

1. A rocker arm for transmitting rotational motion from a camshaft to opening and closing motion of a combustion valve in an internal combustion engine, said rocker arm comprising:

an outer arm;

an inner arm which selectively pivots relative to said outer arm about a pivot axis;

a lost motion spring which biases said inner arm to pivot relative to said outer arm in a first rotational direction;

a lock pin which is displaced along a lock pin axis between 1) a coupled position in which said lock pin prevents said inner arm from pivoting relative to said outer arm past a predetermined position of said inner arm relative to said outer arm in a second rotational direction which is opposite of said first rotational direction and 2) a decoupled position in which said lock pin allows said inner arm to pivot relative to said outer arm past said predetermined position in said second rotational direction;

a linkage which is slidable along a linkage axis, said linkage comprising a first linkage portion through which said linkage axis passes; a second linkage portion which extends from said first linkage portion laterally outward from said linkage axis and includes a second linkage portion surface which is configured to engage an actuator which causes said linkage to slide along said linkage axis; and a third linkage portion which extends from said first linkage portion laterally outward from said first linkage portion and which includes a third linkage portion surface which engages said lock pin such that movement of said linkage along said linkage axis affects a position of said lock pin along said lock pin axis; and guiding means which guides said linkage along said linkage axis.

2. A rocker arm as in claim 1, wherein said guiding means is fixed to said outer arm.

3. A rocker arm as in claim 1, wherein said guiding means is a bore extending through said outer arm and centered about said linkage axis.

4. A rocker arm as in claim 3, wherein said bore is cylindrical.

5. A rocker arm as in claim 4, wherein said first linkage portion is cylindrical and located within said bore.

6. A rocker arm as in claim 5, wherein said linkage includes a linkage anti-rotation surface which engages an outer arm anti-rotation surface of said outer arm, thereby preventing rotation of said linkage about said linkage axis.

7. A rocker arm as in claim 6, wherein said linkage anti-rotation surface is located on said second linkage portion.

8. A rocker arm as in claim 1, wherein said linkage axis is parallel to said lock pin axis.

9. A rocker arm as in claim 1, wherein:

said second linkage portion includes a second linkage portion bore within which said first linkage portion is located; and said third linkage portion includes a third linkage portion bore within which said first linkage portion is located.

10. A rocker arm as in claim 1, wherein:

said outer arm includes a lock pin bore which is centered about, and extends along, said lock pin axis;

said lock pin is located within said lock pin bore; and said lock pin axis extends through said third linkage portion surface.

11. A rocker arm as in claim 10, wherein said lock pin axis does not extend through said second linkage portion surface.

12. A rocker arm as in claim 1, wherein:

said second linkage portion surface faces in a second linkage portion surface direction which is parallel to said linkage axis; and said third linkage portion surface faces in a third linkage portion surface direction which is parallel to said linkage axis and opposite in direction to said second linkage portion surface direction.

13. A rocker arm as in claim 1, wherein:

said guiding means is a dovetail protrusion fixed to said outer arm; and said linkage includes a female dovetail recess within which said dovetail protrusion is located.

14. A rocker arm as in claim 1, wherein:

said guiding means is a male T-protrusion fixed to said outer arm; and said linkage includes a female T-recess within which said male T-protrusion is located.

* * * * *